United States Patent [19]

Hoffberger

[11] 4,262,560

[45] Apr. 21, 1981

[54] SECURING AND LOOSENING DEVICE FOR BOTTLES, JARS AND THE LIKE

[76] Inventor: Charles C. Hoffberger, 608 S. Pineapple Ave., Sarasota, Fla. 33577

[21] Appl. No.: 69,840

[22] Filed: Aug. 27, 1979

[51] Int. Cl.[3] ..... B67B 7/18

[52] U.S. Cl. ..... 81/3.3 R

[58] Field of Search ..... 81/3.3 R, 3.31, 3.3 A, 81/3.4, 120; 248/205 A

[56] References Cited

U.S. PATENT DOCUMENTS

| | | | |
|---|---|---|---|
| 2,810,311 | 10/1957 | Smith | 81/3.3 R |
| 3,247,742 | 4/1966 | Woodbury | 81/3.4 |
| 3,367,610 | 2/1968 | Lindquist | 248/205 A |
| 4,073,205 | 2/1978 | Sillman | 81/3.4 |

FOREIGN PATENT DOCUMENTS

| | | | |
|---|---|---|---|
| 1950256 | 4/1971 | Fed. Rep. of Germany | 81/3.4 |
| 772929 | 4/1957 | United Kingdom | 81/3.4 |

*Primary Examiner*—Roscoe V. Parker

[57] ABSTRACT

An isosceles triangular plate with depending flanges on its two equal sides is provided, adaptable for mounting under kitchen or galley shelves or cabinets for the purpose of loosening and tightening screw-type lids or caps of jars, bottles, and the like. A resilient rubber gripping bar is fixed to said triangular plate and bisects the angle between said flanges. Screw type closures are loosened or tightened by their insertion on the appropriate side of said bar and rotated clockwise or counterclockwise respectively. The camming action of the flange serves to wedge the lid more tightly against the rubber bar, thus increasing its gripping force.

7 Claims, 4 Drawing Figures

SECURING AND LOOSENING DEVICE FOR BOTTLES, JARS AND THE LIKE

This invention relates to a device for securing and loosening a threaded screw cap of a jar or bottle which may contain liquid or solid material. This invention is also directed to a device which may be permanently anchored in a kitchen or galley to allow a means for loosening seemingly unopenable screw caps for tightening the same to insure against ambient leakage or air permeability.

Thus, a primary object of this invention is to provide a simplified and novel structure enabling easy removal and tightening of screw cap jars or vessels.

Another object of this invention is to provide an apparatus which enables persons of debilitated strength a convenient means of securing or loosening jar or bottle tops. It will thus be seen that this invention will advantageously permit people suffering from such diseases as arthritis to easily open and tightly close screw top containers such as jars and bottles.

A still further object of this invention is to provide a container opener and holder for permitting visually handicapped persons a means of opening and closing jars and bottles. With this structure firmly anchored in the kitchen of such a handicapped person, he or she will be able to easily locate and decipher which side of the unit is used for tightening and loosening a screw cap.

An additional objective of this invention resides in a convenient mountable and demountable unit that will permit persons interested in the home canning or bottling of fruits, vegetables, etc. a means to insure that the vessel containing the subject matters of interest is adequately secured against entry of ambient air, the admission of which may cause oxidation and subsequent formation of botulin and consequent food poisoning via botulism. This container opener will also enable the canner or bottler a facile means to loosen a jar or bottle lid which has been rather tightly secured to prevent such air leakage.

One embodiment of this invention resides in the provision of a device for gripping and turning a screw cap of a threaded vessel which comprises a substrate having placed thereon a center piece having a gripping means to grip said screw cap, which piece forms two substantially right triangles with the bottom portion of said substrate and two relatively smooth surfaces as the hypotenuse of said right triangles wherein said threaded container is disposed with its screw cap abutting both said rubber center piece and one of said hypotenuses.

Another embodiment of this invention resides in a device for tightening or loosening the screw tops of threaded vessels which comprises a V-shaped wedge having a first side possessing a relatively smooth interior edge and a second side possessing a relatively smooth interior edge, wherein both first and second sides intersect to form the apex of said V-shaped wedge; and a flexible gripping means disposed within said V-shaped wedge and interconnecting a line parallel to said apex to form two wedge like structures between said smooth first and second sides and said flexible gripping means; one of said two wedge-like structures being receptive to said screw cap which is loosened by rotating said vessel in an opening direction of rotation and the second of said wedge-like structure being receptive to said screw cap which is tightened by rotating said vessel in a closing direction of rotation.

A third embodiment of this invention resides in a container opener for securing or loosening a bottle or jar which comprises a wedge shaped planar surface formed by a flexible rubber gripping means and a smooth edge.

A preferred embodiment of this invention resides in a container opener and closer for securing or loosening a threaded screw top of a bottle or jar which comprises a triangular structure with relatively smooth interiors on two sides of said triangle and a gripping means situated substantially parallel to the apex of said triangle, formed by the intersection of the defined sides, and having relatively smooth interiors and being substantially perpendicular to the third side or base of said triangle.

PRIOR ART

Certain types of jar openers are known to the art. For example, U.S. Pat. No. 3,143,904, issued to Yerkes, discloses a container opening device with quite sharp teeth transversing one side of the opener. It is apparent from the description in that patent that sharp metal teeth are essential to his opening device. The Eames U.S. Pat. No. 1,837,257 discloses a wall mountable device with one inflexible serrated edge for removing or unscrewing a cap from a jar. The Hogan et al. U.S. Pat. No. 4,085,632 discloses a PVC-type material containing two nickel plated metal blades mounted thereon for the removal of a screw threaded cap. The opening device possesses a flat metal element and one that is serrated to engage the screw cap for loosening.

A fruit jar cover fastener and remover is disclosed in U.S. Pat. No. 1,475,716, issued to Overbaugh et al. In this fastener and remover device a mason jar is tilted to effect a converging pressure upon the screw cap and aide in its removal or fastening. Another such kitchen utensil is disclosed in Haase, U.S. Pat. No. 1,707,804. This utensil contains at least one serrated edge in a wedge-type shape for both tightening and removing jar lids. An adjustable screw cap remover is referred to in Wilson, U.S. Pat. No. 2,671,362. The latter possesses a pivot point to enable various sized jars to be loosened or tightened by means of a serrated edge and a smooth edge. A device for tightening or loosening lids possessing two serrated edges and two flat edges is disclosed in Smith, U.S. Pat. No. 2,810,311. It can be seen from Smith, as well as others of the above cited references, that such closure devices can be firmly secured to a kitchen cabinet and that heretofore all contain at least one inflexible serrated or jagged metal edge to accomplish the pressure necessary to open or close the subject closure. As noted below, the device of this invention differs from all of these.

DETAILED DESCRIPTION OF INVENTION

The instant implement is substantially in the form of an isosceles triangle. Thus, the two edges forming the apex of the triangle are generally of equidistant length. However, it is considered within the scope of this invention that either of these edges forming the apex may be of varied length. The interior of these sides is formed of a smooth material which will permit the free rotation of the screw cap when the same is placed adjacent to the side. The smooth material may be polyvinylchloride plastic, polyurethane, wood, sanded wood, polished metal, etc. At the alternative ends of these sides forming the triangle's apex is the third side of the triangle, herein referred to as the base side. This base side may be longer, shorter, or even the same length as the two sides of the triangle. The instant closing and opening device has, interconnecting the apex and the base side, a flexible gripping means, which may comprise a flexible rubber material made of any rubberish polymeric material such as synthetic rubber, 1,3-butadiene rubber, styrene-butadiene rubber, neoprene rubber, butyl rubber, nitrile rubber, polybutadiene rubber, polyisoprene rubber, ethylene-propylene rubber, etc. Natural rubber may also be used as the flexible insert where cost is not prohibitive. This gripping means acts to grip the top of the jar or bottle to be opened and holds the same in place while the bottom of the jar or bottle is rotated in a desired manner so as to either tighten or loosen the jar top. With this flexible rubber material insert, one side of the triangle formed by the base side, smooth side of the triangle and flexible rubber strip will be useful for tightening, and the other opposite triangular side for loosening, the jar top. It is important to recognize that the sides are not interchangable, that is, the side used for tightening the top may not be utilized fo loosening the same. This is believed a unique result of the rubberish flexible gripping means. This is likewise true for the side loosening the top.

The substrate of this holder may be fastened by attachment means to a counter or cabinet in a kitchen or boat's or camper's galley. As depicted in FIG. 1 of applicant's drawings, when the device is secured to a cabinet, it is only the right side which may be utilized to secure the top by rotating the vessel in a counterclockwise position. In the alternative, the jar or bottle may only be loosened by turning the same in the clockwise direction on the left side of the flexible gripping means. The fastening means of this holder may comprise either screws, bolts, or any other conventionally mechanical attachment needs. It is also contemplated that the substrate of this holder may contain a laminated adhesive placed thereon to fasten this holder to a roughened or smooth planar surface.

It can be seen from this description that this apparatus provides an easy on and off device without the use of a serrated inflexible edge, even though the rubberish material transversing the apex and base side may have some serrations therein for added friction. It is also contemplated within this invention that the rubberish material not necessarily interconnect the base side but only be placed on a line parallel to the apex and yet perpendicular to the base side. Thus, the rubberish material need not intersect the base plate or the apex to form an operable device.

DESCRIPTION OF THE PREFERRED EMBODIMENT

Figure 1:
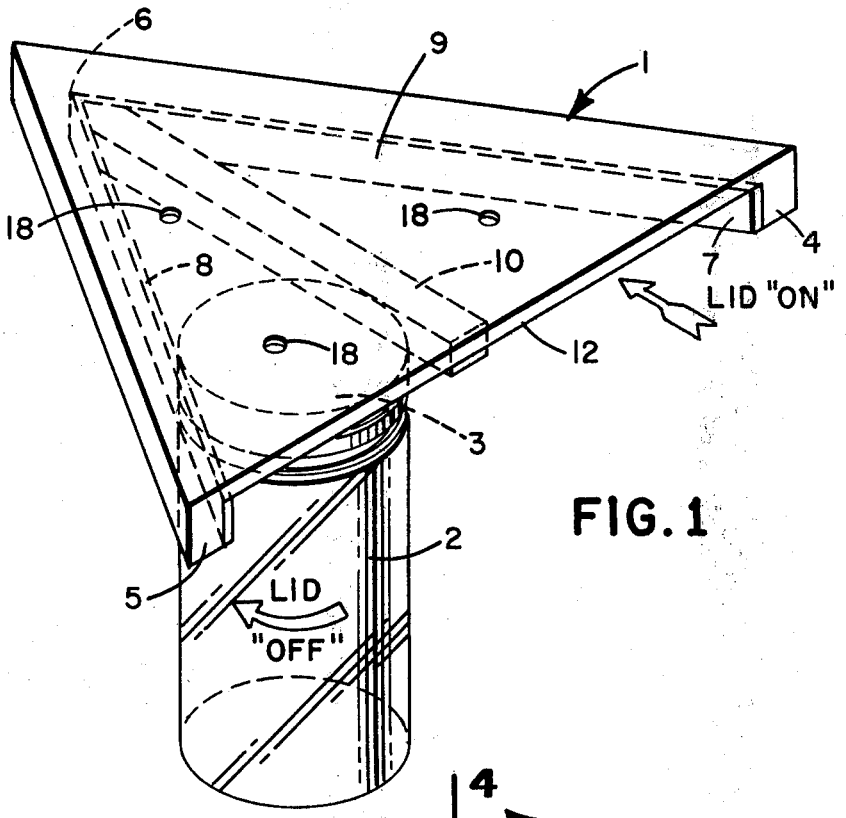
FIG. 1 is a perspective view showing a jar in position for removal of the screw cap therefrom.

In FIG. 1, the screw on-off device is generally indicated at 1. A glass jar 2 with screw cap 3 is shown inserted in the device on the left side preparatory to clockwise rotation of the jar to loosen the cap. The device consists of a plate 9 in the form of an isosceles triangle, with depending flanges 4 and 5 formed on the equal sides of the triangle. The flanges 4 and 5 have a vertical height below plate 9 on the order of $\frac{3}{8}$ to $\frac{1}{2}$ inch, and they coverge at apex 6. A thin layer of a hard, smooth plastic is cemented to the interior surfaces of flanges 4, 5 and are designated by reference numbers 7, 8 respectively.

A resilient rubber gripping bar 10 bisects apex angle 6 and extends to a point 16 just short of the base 12 of the triangle. Bar 10 is cemented in a groove 14 formed in the bottom surface of plate 9.

Figure 4:
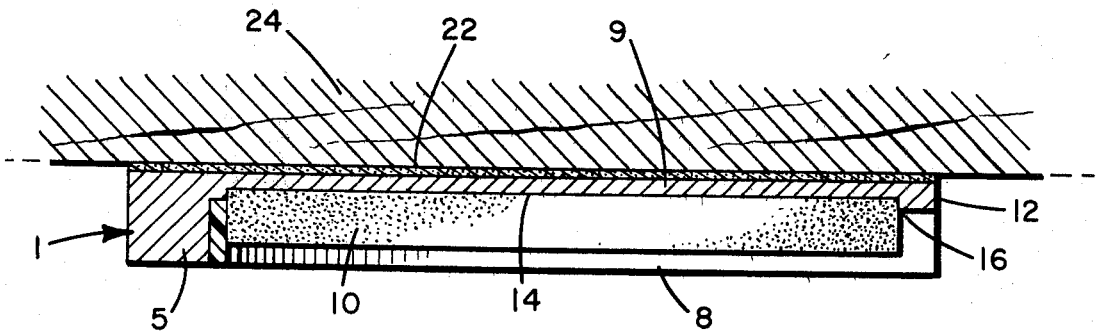
FIG. 4 is a section view taken on the line 4—4 of FIG. 2 looking at one edge of the triangle wherein the device is mounted to a wall by an adhesive means.

Holes 18 are provided in plate 9 for the insertion of appropriate screw fasteners 20. Alternatively, a layer of "contact" adhesive cement 22, as shown n FIG. 4, may be provided on the upper surface of plate 9. In either case, the device is secured to an appropriate supporting structure 24.

Figure 2:
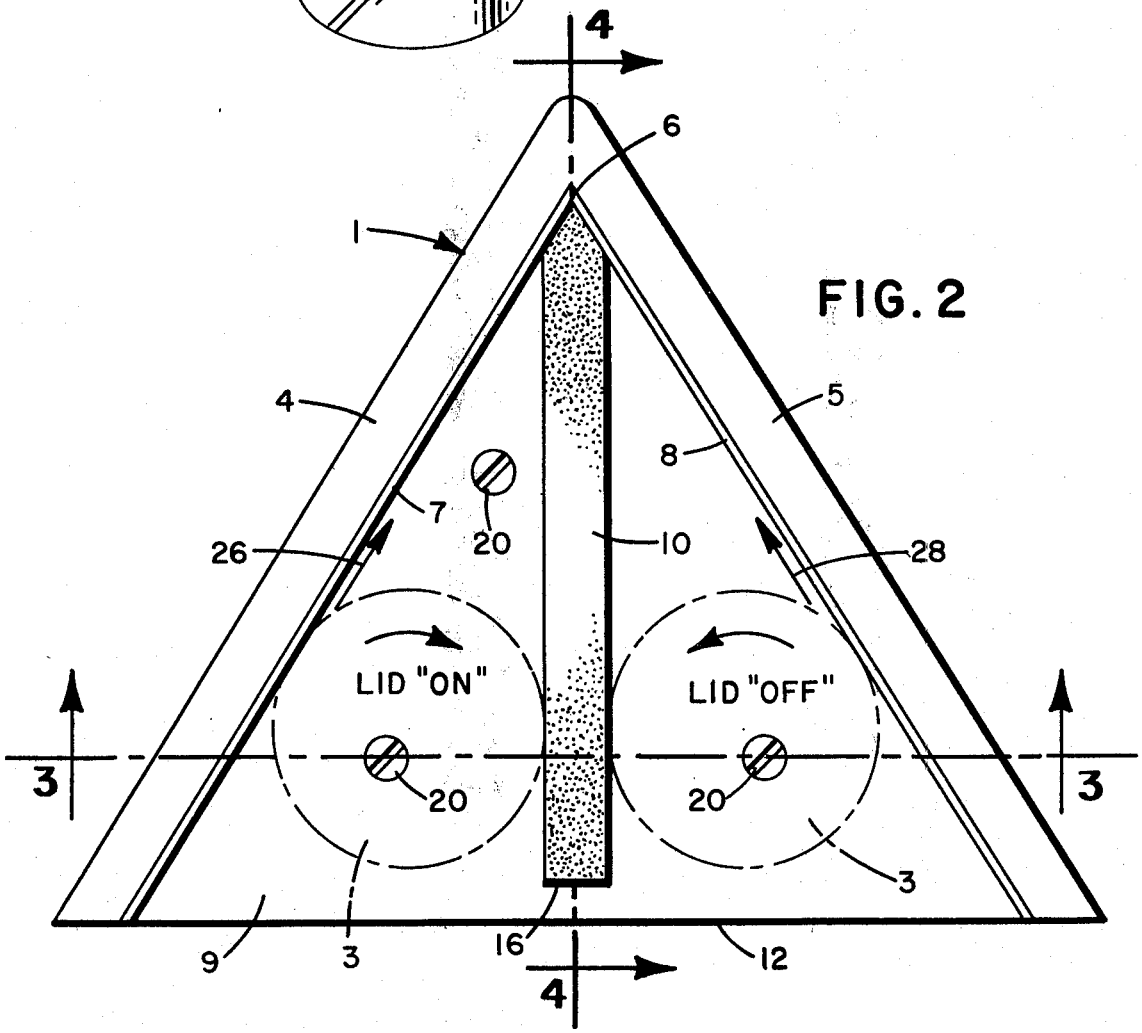
FIG. 2 is a bottom plan view showing two jars in position for removing or tightening the screw caps.
Figure 3:
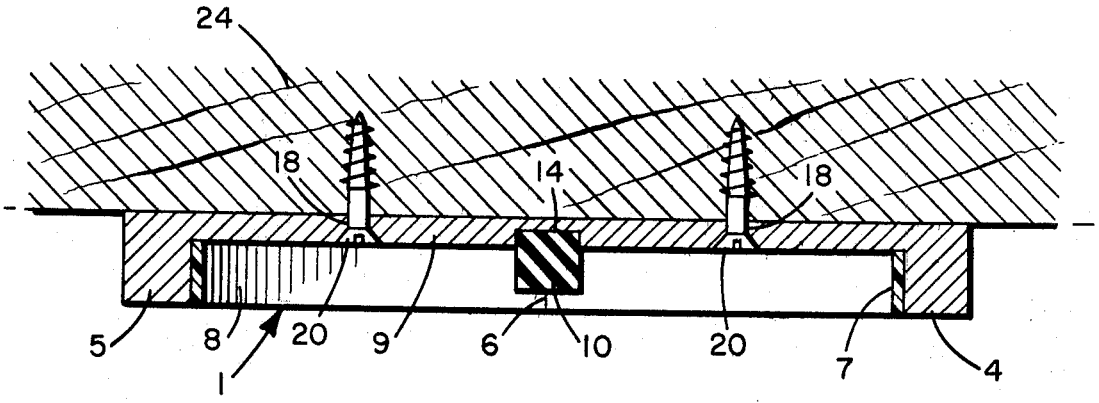
FIG. 3 is a section view taken on the line 3—3 of FIG. 2 and looking at the base of the triangle with the device connected to a wall by screws.

Looking at FIG. 2, it is seen that when a jar lid is inserted into the device and rotated, the lid tends to slide down the slippery surface 7 or 8 toward apex 6, as indicated by arrows 26, 28, thus wedging the lid into tighter engagement with the gripping bar 10.

This arrangement allows a large range of sizes of screw lids or caps to be loosened or tightened easily.

I claim as my invention:

1. A device for tightening or loosening a screw top of a threaded vessel comprising a unitary triangular wedge shape having a planar substrate wherein all perimeter sides of said substrate of said triangle intersect to form an isosceles or equilateral triangle having a base line, said triangular wedge shape having a first and second side raised above said substrate and having a relatively smooth interior edge, both said first and second side at one terminus each interconnecting to form an apex of said triangular shape and the other terminus of each intersecting the base line of said triangular perimeter, said triangular wedge shape possessing a raised, relatively smooth sided rubberish flexible gripping means disposed in a plane parallel to the plane in which said apex is situated to form two right triangles within said isosceles or equilateral triangle wherein;

(a) a first right triangle is formed by one-half of the planar substrate base line, the relatively smooth sided rubberish flexible gripping means and said first smooth side; said first right triangle being receptive to said screw top of said threaded vessel wherein said screw top is loosened by rotating said vessel in an opening direction of rotation; and (b) a second right triangle is formed by one-half of the planar base line, which is distinct from the one-half of planar base line of said first right triangle, the relatively smooth sided rubberish flexible gripping means and said second smooth side; said second right triangle being respective to said screw top which is tightened by rotating said vessel in a closing direction of rotation.

2. The device of claim 1 wherein said relatively smooth sided flexible gripping means comprises a flexible rubber strip.

3. The device of claim 1 wherein said device is mounted substrate side up with the first and second smooth sides and the relatively smooth sided flexible gripping means extending downwardly, wherein said vessel closing rotation is counterclockwise and wherein said vessel opening rotation is clockwise.

4. The device of claim 1, wherein said substrate is equipped with a fastener means to attach said substrate to a planar surface.

5. The device of claim 1 wherein said substrate is attached to said planar surface by an adhesive fastener means laminated to the bottom of said substrate.

6. The device of claim 1 wherein said fastener means comprises a screw or bolt.

7. The device of claim 1 wherein said relatively smooth sided flexible rubberish gripping means comprises synthetic rubber.

* * * * *